US010837150B2

(12) United States Patent
Muegerl

(10) Patent No.: US 10,837,150 B2
(45) Date of Patent: Nov. 17, 2020

(54) STACKABLE COMPACT HIGH THREAT BARRIER

(71) Applicant: Gerard J. Muegerl, Goshen, IN (US)

(72) Inventor: Gerard J. Muegerl, Goshen, IN (US)

(73) Assignee: Spirit of America Corporation, Warsaw, IN (US)

( * ) Notice: Subject to any disclaimer, the term of this patent is extended or adjusted under 35 U.S.C. 154(b) by 0 days.

(21) Appl. No.: 14/961,202

(22) Filed: Dec. 7, 2015

(65) Prior Publication Data

US 2017/0159251 A1 Jun. 8, 2017

(51) Int. Cl.
*E01F 15/00* (2006.01)
*E01F 15/08* (2006.01)

(52) U.S. Cl.
CPC ..... *E01F 15/088* (2013.01); *E01F 15/086* (2013.01)

(58) Field of Classification Search
CPC ..... E01F 15/08; E01F 15/083; E01F 15/086
USPC ..... 404/6; 256/13.1; 116/63 P
See application file for complete search history.

(56) References Cited

U.S. PATENT DOCUMENTS 2,279,942 A * 4/1942 Hausherr ..... E01F 15/085 256/13.1
2,655,225 A * 10/1953 Harris ..... E04H 6/426 404/6
3,092,371 A * 6/1963 Knudsen ..... E01F 15/083 256/13.1
3,540,699 A * 11/1970 Guzzardella ..... E01F 15/025 256/13.1
4,279,471 A * 7/1981 Rowland ..... E01F 9/553 359/531
4,406,563 A * 9/1983 Urlberger ..... E01F 15/025 256/13.1
4,496,264 A * 1/1985 Casey ..... E01F 15/086 256/13.1
4,515,499 A 5/1985 Furiate
4,710,053 A 12/1987 Kulp et al.
4,859,983 A 8/1989 Kulp et al.
4,869,617 A * 9/1989 Chiodo ..... E01F 15/086 404/13
4,964,750 A * 10/1990 House ..... E01F 15/0476 404/6
4,978,245 A * 12/1990 White ..... E01F 9/70 116/63 P
4,982,931 A * 1/1991 Pomero ..... E01F 15/02 256/13.1

(Continued)

FOREIGN PATENT DOCUMENTS

EP -0522279 A1 * 1/1993 ..... E01F 13/00
GB 2100322 A * 12/1982 ..... E01F 9/654
WO WO-9819015 A1 * 5/1998 ..... E01F 15/0476

*Primary Examiner* — Thomas B Will
*Assistant Examiner* — Katherine J Chu
(74) *Attorney, Agent, or Firm* — Carson LLP; Michael D. Smith

(57) ABSTRACT

A stackable, portable, traffic barrier having a molded elongated body with a generally extruded triangular shape having a longitudinal axis; a separable base; a top; a first pair of opposing sides disposed between the top and the base; a second pair of arcuate opposing sides disposed between the top and the base; a plurality of vertically disposed fillable cavities disposed through the top of the body; and a plurality of caps, where each of the caps has a cross sectional shape suitable for functionally engaging a corresponding cavity.

16 Claims, 6 Drawing Sheets

(56) References Cited

U.S. PATENT DOCUMENTS 5,088,874 A * 2/1992 Quittner ..... E01F 15/006 256/13.1
5,118,216 A * 6/1992 Smith ..... E01F 15/083 256/13.1
5,131,786 A * 7/1992 House ..... B65D 88/76 404/6
5,137,391 A * 8/1992 Ballesteros ..... E01F 15/083 404/6
5,375,553 A * 12/1994 Chen ..... E01F 9/688 116/63 C
5,406,039 A 4/1995 Rerup et al.
5,468,093 A * 11/1995 Voigt ..... E01F 15/0461 404/6
5,498,101 A * 3/1996 Braverman ..... E01F 15/088 256/13.1
5,611,641 A * 3/1997 Christensen ..... E01F 13/022 256/1
D385,362 S * 10/1997 Rossetti ..... D25/38.1
5,836,714 A 11/1998 Christensen
5,860,386 A * 1/1999 Schwab ..... B60Q 7/00 116/63 C
5,908,262 A * 6/1999 Ahn ..... E01F 9/675 404/9
5,988,934 A * 11/1999 Wasserstrom ..... E01F 15/083 256/13.1
6,086,285 A 7/2000 Christensen
D431,657 S * 10/2000 Wasserstrom ..... D25/113
6,200,063 B1 * 3/2001 Fritzinger ..... E01F 15/086 256/13.1
6,305,312 B1 * 10/2001 Bent ..... E01F 9/688 116/63 P
6,382,870 B1 5/2002 Gertz
6,669,402 B1 * 12/2003 Davis ..... E01F 15/088 256/13.1
6,672,799 B2 1/2004 Earl
D493,116 S * 7/2004 Richardson ..... D10/113.3
6,835,024 B1 * 12/2004 Gertz ..... E01F 15/146 256/13.1
7,144,188 B1 * 12/2006 Mallinson ..... E01F 15/086 404/6
7,234,275 B1 * 6/2007 Haggy ..... E01F 13/022 160/135
7,275,888 B1 10/2007 Christensen et al.
7,537,411 B2 * 5/2009 Yodock, Jr. ..... E01F 15/083 256/13.1
8,061,925 B2 * 11/2011 Volkmann ..... E01F 15/088 256/13.1
8,568,057 B2 * 10/2013 Rodriguez ..... E01F 15/088 256/13.1
8,777,510 B2 * 7/2014 Maus ..... E01F 15/086 256/13.1
8,939,675 B2 * 1/2015 Christensen ..... E01F 13/022 256/13.1
9,334,614 B1 * 5/2016 Zoellner ..... E01F 9/669
2002/0067951 A1 * 6/2002 Paterson ..... E01F 15/0453 404/6
2005/0201828 A1 * 9/2005 Kang ..... E01F 15/088 404/6
2010/0196094 A1 * 8/2010 Kulp ..... E01F 15/086 404/6
2015/0315754 A1 * 11/2015 Kunkel ..... E01F 9/688 404/6

* cited by examiner

STACKABLE COMPACT HIGH THREAT BARRIER

BACKGROUND

1. Field of the Invention

The present invention relates generally to vehicle traffic barriers, and, more particularly, to stackable, transportable, vehicle traffic barriers.

2. Description of the Related Art

U.S. Pat. No. 4,515,499 discloses a traffic lane delineator that includes an elongate centrally disposed planar strip flanked on at least one side, and generally both sides, by outwardly extending tabs or ribs. The width of each rib may be equal to the space between adjacent ribs or the rib width and spacing therebetween may be varied if desired. This configuration provides an audible warning if a moving vehicle engages and drives upon the ribs. The planar strip preferably also includes a longitudinally extending double yellow line marking which may include reflective material. A physical barrier along the central strip may take the form of spaced-apart stanchions which may include reflective material for visibly delineating the traffic lanes. The delineator may be readily installed on a lane surface as needed as well as removed and rolled or stacked for compact storage.

U.S. Pat. No. 4,710,053 discloses a traffic control device constructed as either a one piece or two-piece device of a resilient plastic by molding. Both the one piece and two-piece devices are constructed to have a ground engaging surface defined with a multiplicity of dependent elements arranged thereon in a preselected pattern for distributing the weight of any ballast means over the dependent elements so that they function as localized pressure points to more firmly engage the supporting surface to minimize their movement on the supporting surface due to wind gusts, vibrations or the like. The two-piece device is constructed with a base element that not only includes the dependent elements but also skids for permitting the assembled two-piece device to be slid over a supporting surface on the skids to prevent the assembled two pieces from becoming unintentionally detached while being slid. The devices are capable of being stacked with and without the warning light secured thereto and present the appearance of a formidable object.

U.S. Pat. No. 4,859,983 discloses a traffic barricade of the A-frame type constructed of a lightweight material such as plastic to have a forbidding appearance. The barricade members are unitarily constructed to be interchangeable and with integral hinge mechanisms. The hinge mechanisms have detent elements for improving the resistance to winds tending to cause the closure of the "A" stance of the barricade. The barricade permits a damaged hinge element to be readily replaced. Ballast may be added to a storage compartment arranged adjacent the supporting surface for the barricade. The design of the plastic barricade permits a warning light to be directly secured by a mounting bolt functioning as a hinge pin. The individual barricade members may be stacked with substantially no relative movement of the stacked members.

U.S. Pat. No. 5,406,039 discloses an acoustical barrier wall system for use as an external wall acoustical attenuator for sound sources. The wall system comprises a plurality of acoustical barrier panels adapted for vertically stacked co-operating engagement. There are first and second attachment members each having a first end anchored within the main body portion of the acoustical barrier panels and an opposite threaded second end extending outwardly beyond the main body portion. There are first and second upright bracing members, each having a corresponding plurality of attachment member receiving means spaced therealong, the attachment member receiving means being adapted to receive the respective first and second attachment members therein. Connecting means in the form of co-operating nuts are adapted to connect the attachment members and the attachment member receiving means in secured relation to one another. The plurality of vertically stacked acoustical barrier panels are secured together by the attachment members, the first and second upright bracing members, and the connecting means to thereby form a wall section for unitary placement between a pair of spaced upright frame members adapted to supportingly receive the plurality of acoustical barrier panels in vertically stacked cooperative engagement therebetween. The first and second upright bracing members are adapted for secure fastening to the respective one of the pair of spaced upright frame members following the unitary placement of the wall section.

U.S. Pat. No. 5,498,101 discloses a plastic road barrier having an elongated base portion having an open center portion and a hollow peripheral portion surrounding the open center portion. The hollow peripheral portion has an inlet into an upper portion thereof for receiving water or other ballast, and an outlet from a lower portion thereof for draining the ballast. An elongated hollow upper portion, open at the bottom, extends upwardly from the base portion, and is preferably but not necessarily integral therewith. Its horizontal dimensions reduce from bottom to top, via steps and/or by being tapered, so that the barriers can be stacked by inserting the upper portion of one barrier a substantial distance into the upper portion of another barrier.

U.S. Pat. No. 5,836,714 discloses portable control barriers for use in sporting or entertainment events having a lightweight housing formed of a resiliently deformable material. Each housing has an interior surface defining an internal chamber that can be selectively filled with a ballast. In one embodiment, the housing has opposing end walls, opposing sidewalls, and a substantially flat bottom wall. A spline and groove are each positioned on one of the opposing end walls. The spline and groove are configured to interlock adjacently positioned barriers. In yet another embodiment, a spout and receiving aperture are positioned on opposing end walls. In this embodiment, the spout of one barrier can be received in sealed fluid communication with the receiving port of an adjacent barrier, thereby allowing fluid communication of the ballast between adjacent barriers. Finally, in yet another embodiment, the bottom wall of the housing can be arched so as to form a passageway extending through the barrier. The bottom wall has a surface that is complementary to the top surface of the housing so that a plurality of barriers can be nestably stacked.

U.S. Pat. No. 6,086,285 discloses a barrier system that includes discrete movable barriers molded from a resiliently deformable plastic. Each of the barriers includes a housing having opposing front and back walls and opposing triangular shaped sidewalls. The front and back walls extend from a floor and intersect at a rounded top portion. Each barrier includes an interior surface that defines an internal chamber. The internal chamber can be selective filled with a ballast through an opening. Recessed within the front wall and back wall are a plurality of pockets. The pockets form reinforcing ribs which substantially prevent the deflection of front and back wall when the internal chamber is filled with ballast. In contrast, the sidewalls are substantially smooth to enhance bowing thereat when the internal chamber is filled with ballast. Recessed within the floor of each barrier adjacent to each of the sidewalls is a slot. Upstanding legs from a U-shaped connector are received within corresponding slots when sidewalls of adjacent barriers are biased together. The connector thus secures the barriers together. A tenon and mortise is formed on the front wall of each of the barriers and are configured such that front walls of opposing barriers can be mated together for stacking and storage. Each of the barriers can also include a rubberized pad mounted to the floor of the barrier to minimize sliding. A plate can also be mounted to each barrier to minimize the potential for tipping the barriers.

U.S. Pat. No. 6,382,870 discloses a sawhorse type of traffic barricade constructed from identical leg units. The legs are equipped with a stop to prevent them from opening beyond a predetermined point. The legs have the cross section of a right triangle, allowing the hypotenuse sides of the legs to nest within each other. The legs may be equipped with complementary convex and concave portions to allow the barricades to be stacked securely atop one another by fitting the portions together.

U.S. Pat. No. 6,672,799 discloses a portable barrier of closed hollow prismatic module configuration. A dense fill material is loaded onto the bottom panel prior to closure providing mass for strength and stability against impacts. The flat panels may be hingeably interconnected and foldable to optionally form a compact stackable configuration for storage and transport. A multiplicity of such modules may be positioned and connected to form a continuous massive wall for such uses as reducing damaging wave action, preventing beach erosion, directing water in flood areas, and providing highway barriers for guidance and safety.

U.S. Pat. No. 7,144,188 discloses a barrier assembly having first, second and third bodies that are vertically stacked. Each body includes a top surface and side surfaces. Inlet ports are formed within the top surfaces. Isolated chambers are formed within and are equidistantly spaced from a center of each body. The bodies include opposed ends that have serrations formed therewith that are interfitted for inhibiting lateral movement of the bodies during collision. The bodies also include indentations formed therein for receiving a user's hands or a fork lift arm, and assisting the user to transport the bodies. Reinforcement rods, formed from non-corrosive material, traverse through the bodies. At least one reinforcement rod is medially seated between the isolated compartments for counterbalancing a combined weight of the bodies. A connector rod is conjoined to the bodies such that the bodies are prohibited from disengaging while experiencing an impact force.

U.S. Pat. No. 7,275,888 discloses a stackable interlocking barrier system that includes a first barrier having a front wall and a back wall each extending between a top wall and a floor, at least a portion of the front wall being sloped relative to the back wall. A second barrier also has a front wall and a back wall each extending between a top wall and a floor, at least a portion of the front wall being sloped relative to the back wall. The second barrier is inverted relative to the first barrier with the front wall of the second barrier seated against the front wall of the first barrier. A first connector is removably mounted on the first barrier and the second barrier so as to secure the first barrier to the second barrier.

However, what is needed in the art is a vehicle barrier comprising a stackable design for compact transportation within known cargo shipping containers used in water and road transportation.

SUMMARY

In a first exemplary embodiment, the present invention comprises a stackable, portable, vehicle traffic barrier, said barrier having a molded elongated body, said body comprising: a generally extruded triangular shape having a longitudinal axis; a separable base, said base comprising a tapered slot extending along said longitudinal axis; a top, where said top is narrower than said base; a first pair of opposing sides disposed between said top and said base, each side of said first pair of opposing sides comprising a vertically disposed slot and rail; a second pair of opposing sides disposed between said top and said base, each side of said first pair of opposing sides comprising a generally arcuate shape; a plurality of vertically disposed fillable cavities disposed through said top of said body; and a plurality of caps, where each of said caps comprises a cross sectional shape suitable for functionally engaging a corresponding cavity.

In another exemplary embodiment, the present invention comprises a system of stackable, portable, traffic barriers, said system comprising: a first barrier having a molded elongated body, said body including: a generally extruded triangular shape having a longitudinal axis; a separable base, said base comprising a tapered slot extending along said longitudinal axis; a top, where said top is narrower than said base; a first pair of opposing sides disposed between said top and said base, each side of said first pair of opposing sides comprising a vertically disposed slot and rail; a second pair of opposing sides disposed between said top and said base, each side of said first pair of opposing sides comprising a generally arcuate shape; a plurality of vertically disposed fillable cavities disposed through said top of said body; and a plurality of caps, where each of said caps comprises a cross sectional shape suitable for functionally engaging a corresponding cavity; a second barrier having a molded elongated body, said body including: a generally extruded triangular shape having a longitudinal axis; a separable base, said base comprising a tapered slot extending along said longitudinal axis; a top, where said top is narrower than said base; a first pair of opposing sides disposed between said top and said base, each side of said first pair of opposing sides comprising a vertically disposed slot and rail; a second pair of opposing sides disposed between said top and said base, each side of said first pair of opposing sides comprising a generally arcuate shape; a plurality of vertically disposed fillable cavities disposed through said top of said body; and a plurality of caps, where each of said caps comprises a cross sectional shape suitable for functionally engaging a corresponding cavity; wherein said top of second barrier fits into said slot of said base of said first barrier.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings.

Corresponding reference characters indicate corresponding parts throughout the several views. The exemplary embodiments set forth herein are not to be construed as limiting the scope of the invention in any manner.

DETAILED DESCRIPTION OF THE EMBODIMENTS

The present invention will be discussed hereinafter in detail in terms of various exemplary embodiments according to the present invention with reference to the accompanying drawings. In the following detailed description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscuring of the present invention.

Thus, all of the implementations described below are exemplary implementations provided to enable persons skilled in the art to make or use the embodiments of the disclosure and are not intended to limit the scope of the disclosure, which is defined by the claims. As used herein, the word "exemplary" or "illustrative" means "serving as an example, instance, or illustration." Any implementation described herein as "exemplary" or "illustrative" is not necessarily to be construed as preferred or advantageous over other implementations. Moreover, in the present description, the terms "upper", "lower", "left", "rear", "right", "front", "vertical", "horizontal", and derivatives thereof shall relate to the invention as oriented in FIG. 1.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
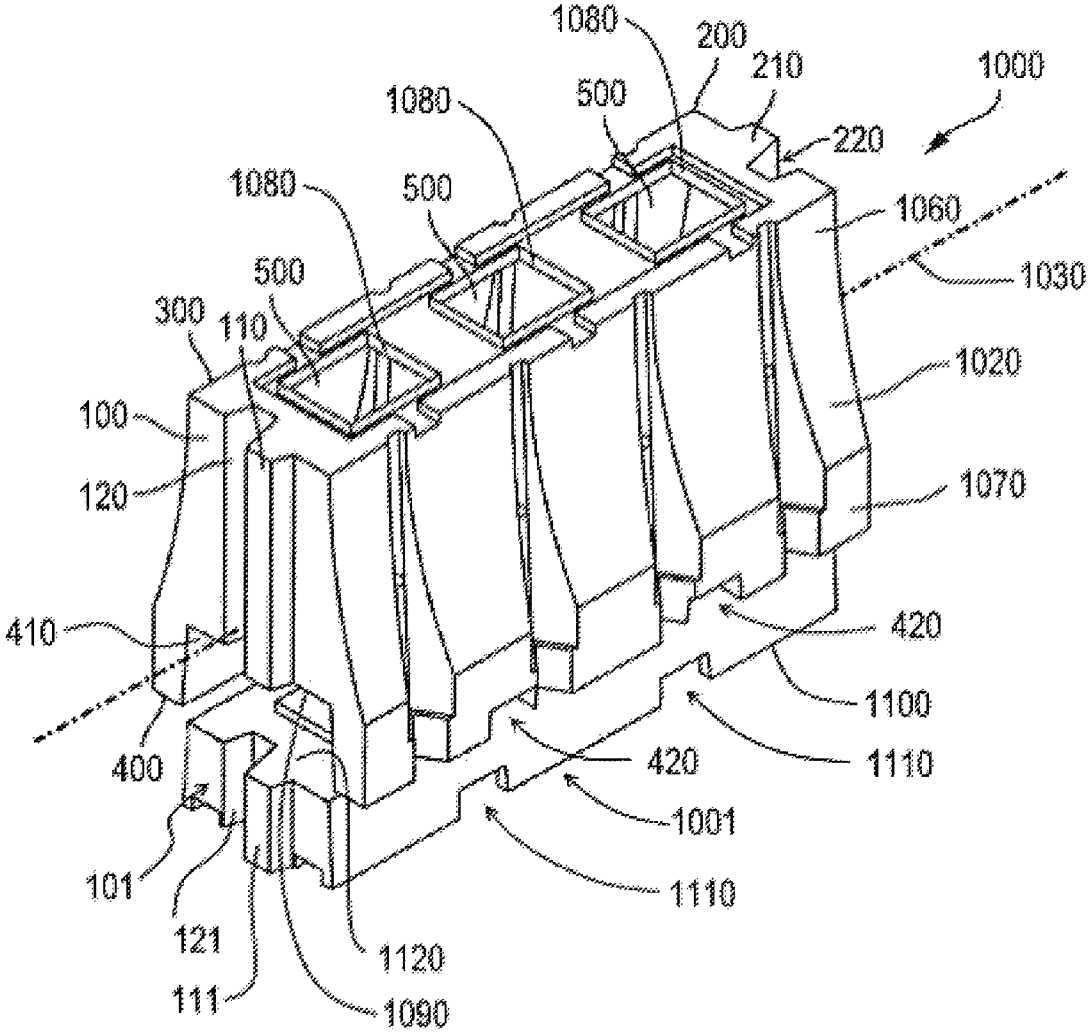
FIG. 1 shows an exploded upper perspective view of a traffic barrier according to an exemplary embodiment of the present invention, the body of which extends along an imaginary longitudinal axis.

Referring first to FIG. 1, there is shown an exploded upper perspective view of traffic barrier 1000 according to an exemplary embodiment of the present invention. As illustrated in FIG. 1, traffic barrier 1000 generally comprises a molded plastic body 1020. However, body 1020 of traffic barrier 1000, in addition to plastic, may comprise any suitable non-corrosive material, such as stainless steel or aluminum. In the preferred embodiment, however, the body of traffic barrier 1000 is comprised of a molded or extruded thermoplastic or thermoset polymer.

As further illustrated in FIG. 1, traffic barrier body 1020 generally comprises a generally trapezoidal cross-sectional shape in directions along the length of an imaginary longitudinal axis 1030. Referring still to FIG. 1, traffic barrier body 1020 comprises a pair of longitudinally opposite ends including a front end surface 100 and a rear end surface 200. Longitudinal axis 1030 defines a length of traffic barrier 1000 between front end surface 100 and rear end surface 200. Front end surface 100 defines a vertically oriented raised rib 110 and a parallel, adjacent, vertically oriented slot 120. Rear end surface 200 defines a vertically oriented raised rib 210 and a parallel, adjacent, vertically oriented slot 220. Raised rib 210 of rear end surface 200 and slot 120 of front end surface 100 of each traffic barrier body 1020 are disposed in imaginary, vertically-oriented plane 1040 that is parallel with longitudinal axis 1030. Likewise, raised rib 110 of front end surface 100 and slot 220 of rear end surface 200 of each traffic barrier body 1020 are disposed in imaginary, vertically-oriented plane 1050 that is parallel with longitudinal axis 1030 and plane 1040.

Traffic barrier body 1020 also has a top portion 1060 that defines top surface 300, a bottom portion 1070 that defines bottom surface 400, and an at least partially hollow interior. As illustrated in FIG. 1, the interior of traffic barrier body 1020 is defined by a plurality of, preferably three, vertically-oriented, fillable cavities 500 having openings 1080 that are distributed in directions along longitudinal axis 1030 and open to top surface 300 as illustrated in FIG. 1.

Figure 4:
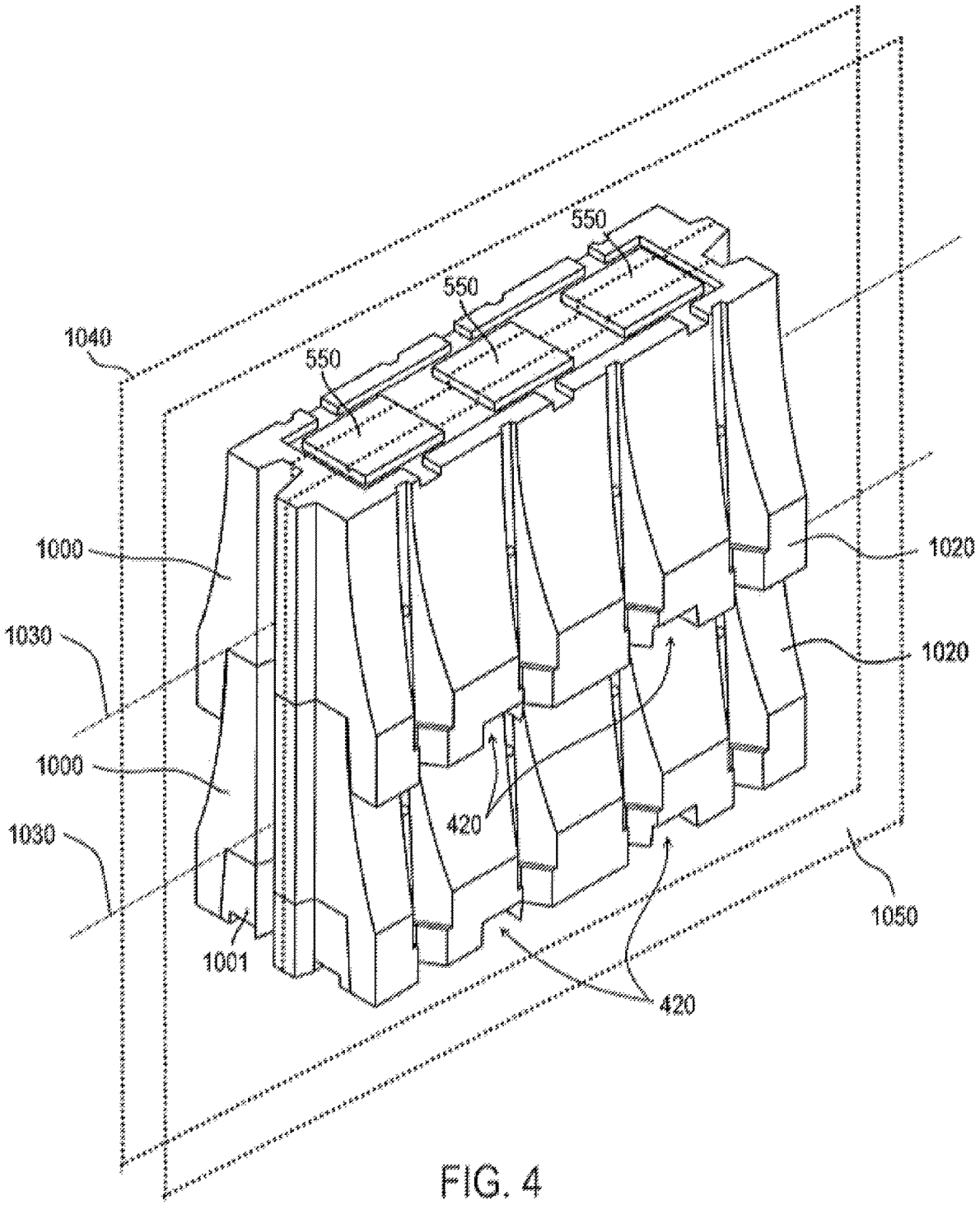
FIG. 4 shows an upper perspective view of a barricade formed of filled, stacked traffic barriers according to an exemplary embodiment of the present invention, the bodies of which extend along imaginary longitudinal axes, and a pair of imaginary parallel planes indicated by dotted lines.

Referring still to FIG. 1, cavity openings 1080 are preferably of a regular shape so that each cavity 500 may be enclosed by caps 550, as shown in FIG. 4. Caps 550 are preferably comprised of the same material as each traffic barrier body 1020. Opening 1080 of each cavity 500 may, for example, be rectangular or square as shown or of any regular geometric shape such a triangle, circle, an octagon, hexagon, etc.

Figure 2:
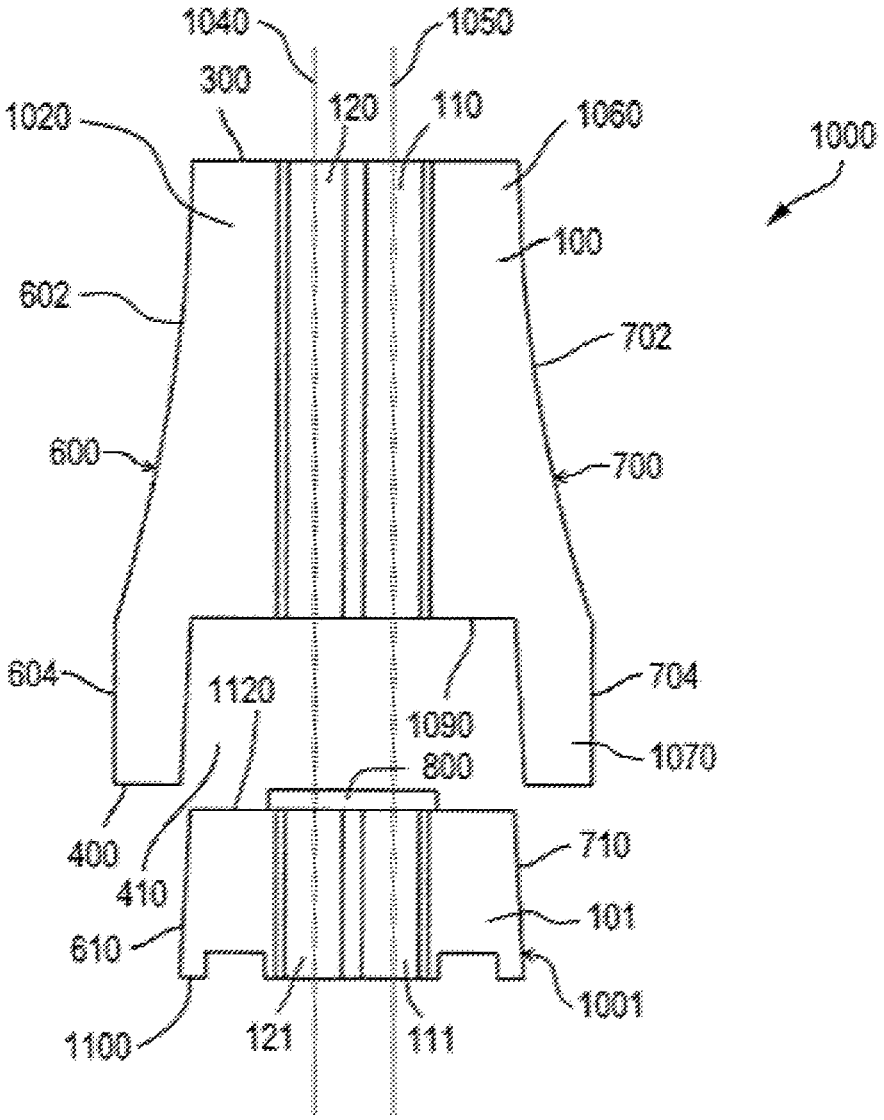
FIG. 2 shows an exploded front end elevation of a traffic barrier according to an exemplary embodiment of the present invention, and a pair of imaginary parallel planes indicated by dotted lines.

Referring now to FIG. 2, there is shown an exploded front end elevation of traffic barrier 1000 according to an exemplary embodiment of the present invention. Traffic barrier body 1020 further defines longitudinal slot 410 in bottom surface 400 that extends between front end surface 100 and rear end surface 200.

As further illustrated in FIG. 2, in the vertical direction slot 410 has a generally tapered shape whereby the lateral width of the top surface 1090 of slot 410 is smaller than the lateral slot width at the bottom of slot 410 in directions perpendicular to planes 1040, 1050. The purpose of this taper is to allow a user of the present invention to stack a plurality of traffic barrier bodies 1020 on top of one another such that the top portion 1060 of a first traffic barrier body 1020 may be received and nest within a corresponding slot 410 of a second, vertically adjacent traffic barrier body 1020.

Referring again to FIG. 2, traffic barrier body 1020 has opposing left and right lateral sides 600 and 700. In longitudinal cross-section, upper portions 602 and 702 of left and right lateral sides 600 and 700, respectively, each have a generally arcuate shape. Each lateral side upper portion 602, 702 slopes laterally outward from its juncture with top surface 300 of traffic barrier body 1020, to its respective juncture with a corresponding lateral side lower portion 604, 704. Each of lateral side lower portions 604 and 704 defines a vertical plane. As illustrated in FIG. 2, upper portion 602 of left lateral side 600 curves outwardly from its juncture with top surface 300 of traffic barrier body 1020, to its juncture with vertically oriented lateral side lower portion 604; and upper portion 702 of right lateral side 700 curves outwardly from its juncture with top surface 300 of traffic barrier body 1020, to its juncture with vertically oriented lateral side lower portion 704.

Figure 3:
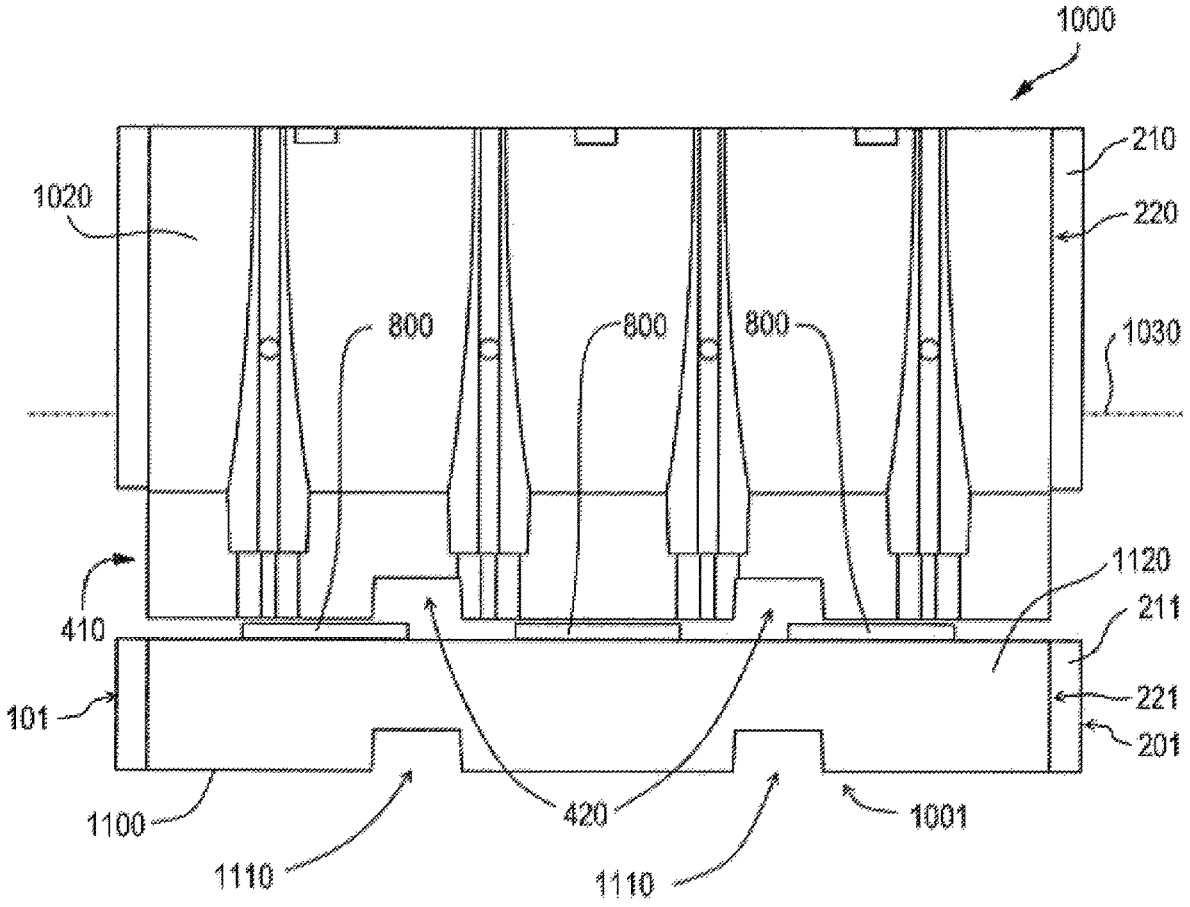
FIG. 3 shows an exploded side elevation of a traffic barrier according to an exemplary embodiment of the present invention, the body of which extends along an imaginary longitudinal axis.

Referring still to FIG. 2, traffic barrier 1000 according to the present invention may further comprise a barrier base 1001. As illustrated in FIGS. 2 and 3, barrier base 1001 is sized and shaped to cooperatively fit within slot 410 of traffic barrier body 1020. Barrier base 1001 has opposing lateral left side 610 and right side 710, each base side 610, 710 having a generally flat surface that tapers inwardly from the bottom surface 1100 of base 1001 to the top surface 1120 of base 1001 to fit cooperatively into slot 410 in bottom surface 400 of traffic barrier body 1020. Base 1001 is used in situations where a single traffic barrier 1000 establishes the vertical height of a barricade, or in conjunction with the bottommost traffic barrier body 1020 of a plurality of vertically stacked traffic barriers bodies 1020 that contribute to the barricade height, as shown in FIG. 4 where a barricade embodiment includes a vertically stacked pair of ballast-filled barrier bodies 1020, with the lowermost barrier body 1020 having the entirety of a barrier base 1001 disposed in its slot 410. As further illustrated in FIG. 4, the openings 1080 of cavities 500 (see FIG. 1) of the uppermost traffic barrier body 1020 are closed by caps 550.

Base 1001 positioned within a longitudinal slot 410 supports surfaces of body bottom portion 1070 that are within that slot 410. FIGS. 2 and 4 also illustrate that longitudinal slot 410 is receivable of the entirety of base 1001, whereby within longitudinal slot 410 the respectively interfacing surfaces of body bottom portion 1070 and base 1001 abut each other, and laterally outside of longitudinal slot 410 the bottom surfaces 400 and 1100, of body bottom portion 1070 and base 1001, respectively, are substantially flush as shown in FIG. 4. In such a barrier embodiment, the bottom surface 400 of body bottom portion 1070 laterally outside of the longitudinal slot 400 in which the entirety of base 1001 is disposed, is unsupported by the base; and one having ordinary skill in the relevant art will appreciate that the vertical height and lateral width of the barrier are unaffected by the entirety of the base 1001 being received into slot 410.

Extending upwardly from top surface 1120 of base 1001 in the depicted embodiments are projections 800, each of which is received in a recess (not shown) in longitudinal slot top surface 1090, as one having ordinary skill in the relevant art would perceive from the drawings, particularly FIGS. 2 and 4.

As shown in FIG. 2, base 1001 defines front end surface 101 having a vertically oriented raised rib 111 and adjacent slot 121 having the same lateral and longitudinal dimensions as corresponding raised rib 110 and slot 120 provided on the front end surface 100 of traffic barrier body 1020. Barrier base 1001 further defines rear end surface 201 having a vertically oriented raised rib 211 and adjacent slot 221 having the same lateral and longitudinal dimensions as corresponding raised rib 210 and slot 220 provided on the rear end surface 200 of traffic barrier body 1020.

Moreover, as one having ordinary skill in the relevant art would perceive from the drawings, particularly FIGS. 3 and 4, with the entirety of base 1001 received in slot 410, laterally extending slots 420 in body bottom surface 400 are aligned in the longitudinal (i.e., along axis 1030) and vertical directions with laterally extending slots 1110 in base bottom surface 1100, the aligned slots receivable of the tines of a forklift (not shown).

Figure 5:
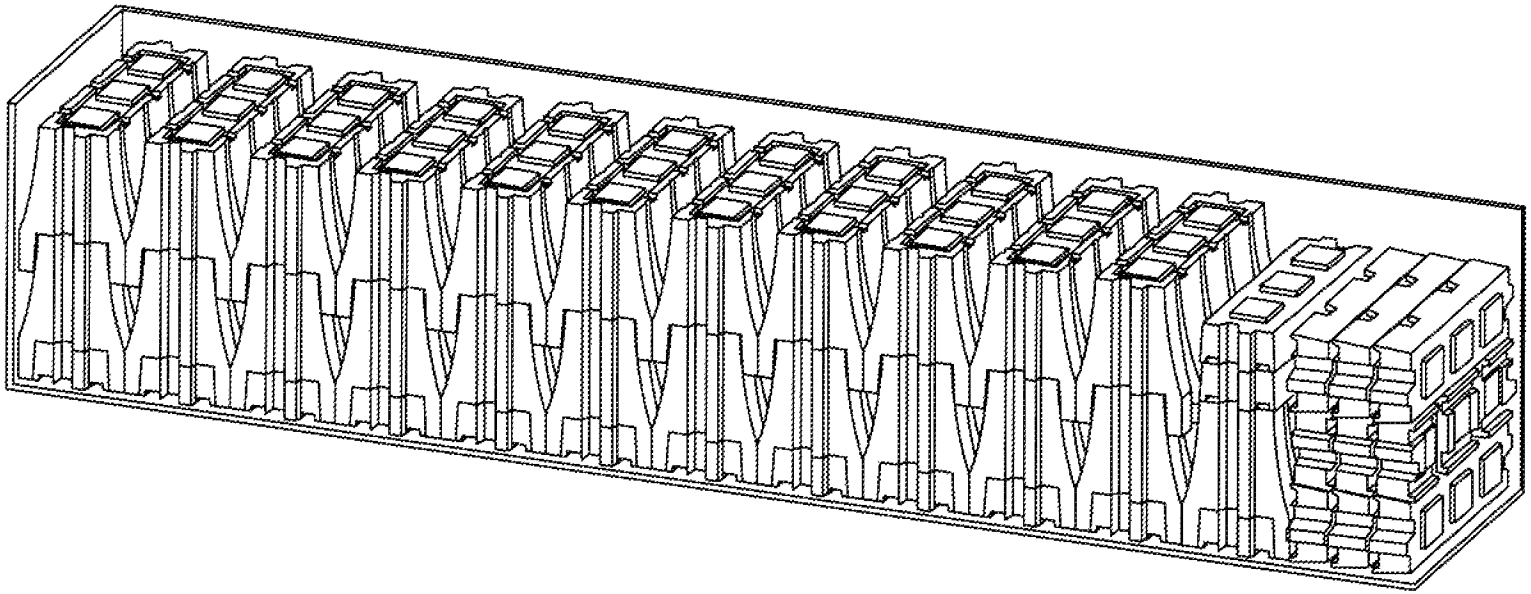
FIG. 5 shows an upper perspective view of a plurality of stacked traffic barriers according to an exemplary embodiment of the present invention in a partially shown shipping container.

Turning now to FIG. 5, there is shown a plurality of pairs of vertically stacked traffic barrier bodies 1020 stored in a partially shown shipping container. As shown in FIG. 5, the flat lateral side lower portions 604 and 704 of the traffic barrier bodies 1020 allow for the convenient, close packing of multiple stacks thereof.

Figure 6:
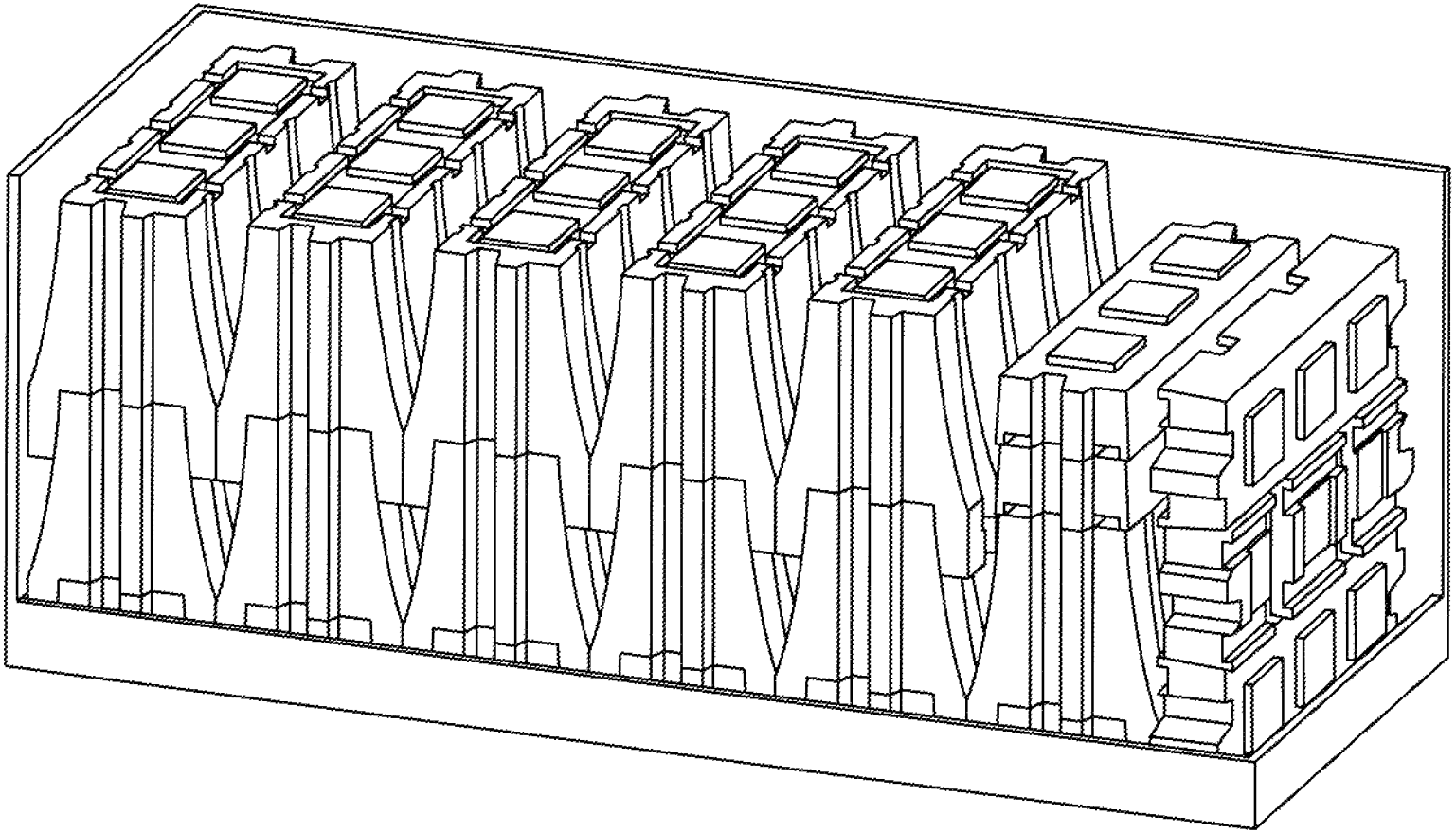
FIG. 6 shows an upper perspective view of a plurality of stacked traffic barriers according to an exemplary embodiment of the present invention in a differently sized, partially shown shipping container.

FIG. 6 shows an alternative packing arrangement of traffic barrier bodies 1020 stored in a relatively smaller shipping container for shipping via land, rail, or sea. It will be appreciated by users of the present invention that the design disclosed and claimed herein allows for many more traffic barriers 1000 to be packaged into standard shipping containers for rail, sea, and land transportation thereof than do prior art traffic barriers.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as conic within known or customary practice in the art to which this invention pertains and which fall within the limits of the appended claims.

The invention claimed is:

1. A stackable, portable traffic, barrier, comprising:

a molded, elongate body extending along a longitudinal axis between opposite longitudinal ends, the body having:

a top portion defining a body top surface, a bottom portion defining a body bottom surface, and opposing first and second lateral sides between which the longitudinal axis is located, the first and second sides extending between the body longitudinal ends and between the body top surface and the body bottom surface; and a separable base;

wherein the lateral distance between the first and second sides is narrower at the body top portion than at the body bottom portion;

wherein the body defines at least one ballast-fillable cavity accessible through at least one opening in the body top surface, whereby the body cavity is receivable of weighting ballast through the at least one opening;

wherein the body bottom surface defines a longitudinal slot extending between the body longitudinal ends, said base removably receivable into the longitudinal slot;

wherein the top portion is configured for removable, nested receipt into a second said barrier body longitudinal slot, whereby use of the barrier with a second said barrier body vertically stackable upon the barrier is facilitated; and wherein the bottom surface of the body laterally outside of the longitudinal slot is unsupported, and the vertical height and the lateral width of the barrier are unaffected, by said separable base received into the longitudinal slot.

2. The stackable, portable traffic barrier of claim 1, wherein the body longitudinal slot is tapered in a vertical direction.

3. The stackable, portable traffic barrier of claim 2, wherein the lateral width of the body longitudinal slot, at the top of the body longitudinal slot is smaller than the lateral width of the body longitudinal slot at the bottom of the body longitudinal slot.

4. The stackable, portable traffic barrier of claim 1, wherein the body is supported at locations within the longitudinal slot by said separable base upon receipt thereof into the longitudinal slot.

5. The stackable, portable traffic barrier of claim 1, wherein the first and second lateral sides of the body each define a longitudinal cross-sectional shape that is generally arcuate.

6. The stackable, portable traffic barrier of claim 5, wherein the generally arcuate shapes define the body top portion.

7. The stackable, portable traffic barrier of claim 5, wherein the first and second lateral sides of the body each define a longitudinal cross-sectional shape that is flat and substantially vertically oriented.

8. The stackable, portable traffic barrier of claim 7, wherein the flat and substantially vertically oriented shapes define the body bottom portion.

9. The stackable, portable traffic barrier of claim 1, comprising a cap selectively disposed over each one of the at least one opening in the body top surface, whereby the at least one cavity is selectively closeable.

10. The stackable, portable traffic barrier of claim 1, wherein the entirety of the base is received into the body longitudinal slot.

11. A barricade comprising:

a first stackable, portable traffic barrier comprising a first barrier body and a separable base; and a second barrier body;

wherein, respective to each said barrier body, the body is molded, elongate, and extends along a longitudinal axis between opposite longitudinal ends, the body having:

a top portion defining a body top surface, a bottom portion defining a body bottom surface, and opposing first and second lateral sides between which the longitudinal axis is located, the first and second sides extending between the body longitudinal ends and between the body top surface and the body bottom surface;

wherein, respective to each barrier body, the lateral distance between the first and second lateral sides is narrower at the body top portion than at the body bottom portion, the body defines at least one ballast-fillable cavity accessible through at least one opening in the body top surface, whereby the body cavity is receivable of weighting ballast through the at least one opening, and the body bottom surface defines a longitudinal slot extending between the body longitudinal ends;

wherein the first barrier base is removably receivable into the longitudinal slot of the first barrier body and, with the first barrier base received into the longitudinal slot of the first barrier body, the bottom surface of the first barrier body laterally outside of the longitudinal slot of the first barrier body is unsupported by the first barrier base and the vertical height and the lateral width of the first barrier are unaffected by the first barrier base; and wherein the top portion of the first barrier body is received into the longitudinal slot of the second barrier body.

12. The barricade of claim 11, wherein the entirety of the first barrier base is received into the longitudinal slot of the first barrier body.

13. A barricade comprising:

a first and a second said stackable, portable traffic barrier according to claim 1;

wherein, respective to each of the first and second barriers, each of the body longitudinal ends has an end surface that defines a vertically oriented rib and a vertically oriented slot;

wherein, respective to each of the first and second barriers, at each body longitudinal end the vertically oriented rib and vertically oriented slot are substantially parallel and extend between the body top surface and the body bottom surface;

wherein, respective to each of the first and second barriers, the vertically oriented rib of each body longitudinal end is longitudinally aligned with the vertically oriented slot of the opposite body longitudinal end; and wherein the first and second barrier bodies are longitudinally adjacent and mutually interengaged through their respective vertically oriented ribs and vertically oriented slots.

14. A barricade comprising:

a first and a second stackable, portable traffic barrier, each of the first and second respective barriers comprising:

a molded, elongate body extending along a longitudinal axis between opposite longitudinal ends, the body having:

a top portion defining a body top surface, a bottom portion defining a body bottom surface, and opposing first and second lateral sides between which the longitudinal axis is located, the first and second sides extending between the body longitudinal ends and between the body top surface and the body bottom surface, and a separable base;

wherein, respective to each of the first and second barriers, the lateral distance between the first and second lateral sides is narrower at the body top portion than at the body bottom portion, the body defines at least one ballast-fillable cavity accessible through at least one opening in the body top surface, whereby the body cavity is receivable of weighting ballast through the at least one opening, and the body bottom surface defines a longitudinal slot extending between the body longitudinal ends;

wherein, respective to each of the first and second barriers, the base is removably receivable into the longitudinal slot and, with the base received into the longitudinal slot, the bottom surface of the body laterally outside of the longitudinal slot is unsupported by the base and the vertical height and the lateral width of the barrier are unaffected by the base;

wherein, respective to each of the first and second barriers, each of the body longitudinal ends has an end surface that defines a vertically oriented rib and a vertically oriented slot, the vertically oriented rib and vertically oriented slot are substantially parallel and extend between the body top surface and the body bottom surface at each body longitudinal end, and the vertically oriented rib of each body longitudinal end is longitudinally aligned with the vertically oriented slot of the opposite body longitudinal end;

wherein the first and second barrier bodies are longitudinally adjacent and mutually interengaged through their respective vertically oriented ribs and vertically oriented slots;

wherein, respective to each of the first and second barriers, the base has opposite longitudinal ends and each of the base longitudinal ends has an end surface that defines a vertically oriented rib and a vertically oriented slot;

wherein at each body longitudinal end the body vertically oriented rib and the body vertically oriented slot are vertically aligned with a base vertically oriented rib and a base vertically oriented slot, respectively; and wherein the first and second barrier bases are longitudinally adjacent and mutually interengaged through their respective vertically oriented ribs and vertically oriented slots.

15. A system of stackable, portable traffic barriers, comprising:

a first molded, elongate barrier body and a second molded, elongate barrier body, each barrier body extending along a respective longitudinal axis between respective opposite longitudinal ends, each first and second barrier body having:

a top portion defining a body top surface provided with at least one opening, a bottom portion defining a body bottom surface, wherein the body bottom surface defines a longitudinal slot extending between the body longitudinal ends, and opposing first and second lateral sides between which the respective longitudinal axis is located, the first and second sides of the body extending between the body longitudinal ends and between the body top surface and the body bottom surface, wherein the lateral distance between the first and second sides of the body is narrower at the body top portion than at the body bottom portion, and wherein the body defines at least one ballast-tillable cavity accessible through the at least one opening provided in the body top surface, whereby the at least one ballast-tillable cavity is receivable of weighting ballast through the at least one opening;

a cap selectively disposed over each one of the at least one opening provided in the body top surface of at least one of the first and second barrier bodies, whereby the at least one cavity thereof is selectively closeable; and a separable base, the entirety of the base disposed in the longitudinal slot of the second barrier body;

wherein the second barrier body is vertically interposed between the base and the first barrier body, and the top portion of the second barrier body is disposed in the longitudinal slot of the first barrier body; and wherein the bottom surface of the second barrier body laterally outside of its longitudinal slot is unsupported by the base, and the vertical height and the lateral width of the system are unaffected by the base.

16. The system of claim 15, wherein support by the base is provided to the second barrier body at locations within the longitudinal slot of the second barrier body.

* * * * *